US011621119B2

(12) United States Patent
Misaki et al.

(10) Patent No.: US 11,621,119 B2
(45) Date of Patent: Apr. 4, 2023

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Takashi Misaki, Mie (JP); Shinichiro Yamamoto, Mie (JP); Seiji Shitama, Mie (JP); Tatsuo Hirabayashi, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 679 days.

(21) Appl. No.: 16/614,504

(22) PCT Filed: May 8, 2018

(86) PCT No.: PCT/JP2018/017762
§ 371 (c)(1),
(2) Date: Nov. 18, 2019

(87) PCT Pub. No.: WO2018/221127
PCT Pub. Date: Dec. 6, 2018

(65) Prior Publication Data

US 2020/0176175 A1 Jun. 4, 2020

(30) Foreign Application Priority Data

May 29, 2017 (JP) ..... JP2017-105287

(51) Int. Cl.
*H01F 27/29* (2006.01)
*H01F 27/26* (2006.01)
(Continued)

(52) U.S. Cl.
CPC ..... *H01F 27/292* (2013.01); *H01F 27/266* (2013.01); *H01F 27/327* (2013.01); *H01F 27/402* (2013.01)

(58) Field of Classification Search
CPC .... H01F 27/292; H01F 27/266; H01F 27/327; H01F 27/402; H01F 27/06;
(Continued)

(56) References Cited

U.S. PATENT DOCUMENTS

2018/0211758 A1 7/2018 Shitama et al.

FOREIGN PATENT DOCUMENTS

JP 2004-095570 A 3/2004
JP 2010-157599 A 7/2010
(Continued)

OTHER PUBLICATIONS

International Search Report, Application No. PCT/JP2018/017762, dated Jul. 31, 2018. ISA/Japan Patent Office.

*Primary Examiner* — Tuyen T Nguyen
(74) *Attorney, Agent, or Firm* — Honigman LLP

(57) ABSTRACT

Provided is a reactor including a coil that has wound portions formed by winding a winding wire, and a magnetic core that includes inner core portions arranged inside of the wound portions and outer core portions arranged outside of the wound portions. The reactor includes an outer resin portion covering at least outer surfaces of the outer core portions. A terminal platform is formed in one piece protruding on the outer surface of an outer resin portion among the outer resin portions and has fastening portions configured to fasten terminal fittings connected to end portions of the winding wire to terminals of an external wiring. A fixing portion is formed in one piece on the terminal platform and fixes the reactor to an installation target. The terminal platform and the fixing portion are integrated and the
(Continued)

thickness of the terminal platform is less than that of the fixing portion.

10 Claims, 9 Drawing Sheets

(51) Int. Cl.
*H01F 27/32* (2006.01)
*H01F 27/40* (2006.01)

(58) Field of Classification Search
CPC ..... H01F 2027/406; H01F 27/263; H01F 27/2828; H01F 27/306; H01F 27/29; H01F 37/00
See application file for complete search history.

(56) References Cited

FOREIGN PATENT DOCUMENTS

| | | | | | |
|---|---|---|---|---|---|
| JP | 2011-049495 | A | 3/2011 | | |
| JP | 2011-054612 | A | 3/2011 | | |
| JP | 2017-028135 | A | 2/2017 | | |
| WO | WO-2014017150 | A1 * | 1/2014 | ..... | H01F 27/02 |

* cited by examiner

REACTOR

CROSS-REFERENCE TO RELATED APPLICATIONS

This application is the U.S. national stage of PCT/JP2018/017762 filed on May 8, 2018, which claims priority of Japanese Patent Application No. JP 2017-105287 filed on May 29, 2017, the contents of which are incorporated herein.

TECHNICAL FIELD

The present disclosure relates to a reactor.

BACKGROUND

A reactor is one component of a circuit that performs a voltage boost operation and a voltage lowering operation. For example, JP 2011-49495A, 2017-28135A, and JP 2017-28142A disclose reactors including: a coil having wound portions formed by winding winding wires; and a ring-shaped magnetic core that includes inner core portions arranged inside of the wound portions, and outer core portions arranged outside of the wound portions. Normally, power is supplied to the coil from an external device such as a power source via external wiring (a lead wire, bus bar, etc.). Also, for example, the reactor is used installed in an installation target, such as a converter case.

JP 2011-49495A discloses that a terminal platform is constituted by covering the outer periphery of a combined body obtained by combining the coil and the magnetic core with an outer resin portion, and integrally molding terminal fittings, which are to be connected to the end portions of the wound portions, on the outer resin portion (see paragraphs [0026] and [0028], FIG. 2, and the like of JP 2011-49495A). The terminal platform is provided with nuts for fastening the terminal fittings and the terminals of the outer wiring with bolts or the like. On the other hand, JP 2017-28135A and JP 2017-28142A disclose that fixing portions for performing fixing to an installation target with bolts are formed on outer resin portions that cover outer core portions (see paragraph [0047], FIG. 1, and the like in JP 2017-28135A, and paragraph [0070], FIG. 1, and the like in JP 2017-28142A).

In recent years, reduction of the size of converters has advanced, and due to using slimmer cases, there has been a tendency for the height of a reactor to be limited, and for an increase the arrangement density of components such as a reactor to be used in a converter. In the reactor according to JP 2011-49495A, the terminal platform is molded in one piece with the outer resin portion above the outer core portions, but there are cases where it is difficult to provide the terminal platform above the outer core portions, in view of the installation space.

SUMMARY

In view of the above, in the present disclosure, a reactor is provided which can further reduce the height of a reactor including a terminal platform.

A reactor according to the present disclosure includes a coil that has wound portions formed by winding a winding wire, and a magnetic core that includes inner core portions arranged inside of the wound portions and outer core portions arranged outside of the wound portions, the reactor including: outer resin portions covering at least outer surfaces of the outer core portions; a terminal platform that is formed in one piece protruding on the outer surface of an outer resin portion among the outer resin portions and has fastening portions configured to fasten terminal fittings connected to end portions of the winding wire to terminals of an external wiring; and a fixing portion that is formed in one piece on the terminal platform and is for fixing the reactor to an installation target. The terminal platform and the fixing portion are integrated, and the thickness of the terminal platform is less than that of the fixing portion.

Advantageous Effects of the Present Disclosure

The reactor of the present disclosure can further reduce the height of a reactor including a terminal platform.

DETAILED DESCRIPTION OF PREFERRED EMBODIMENTS

Figure 1:
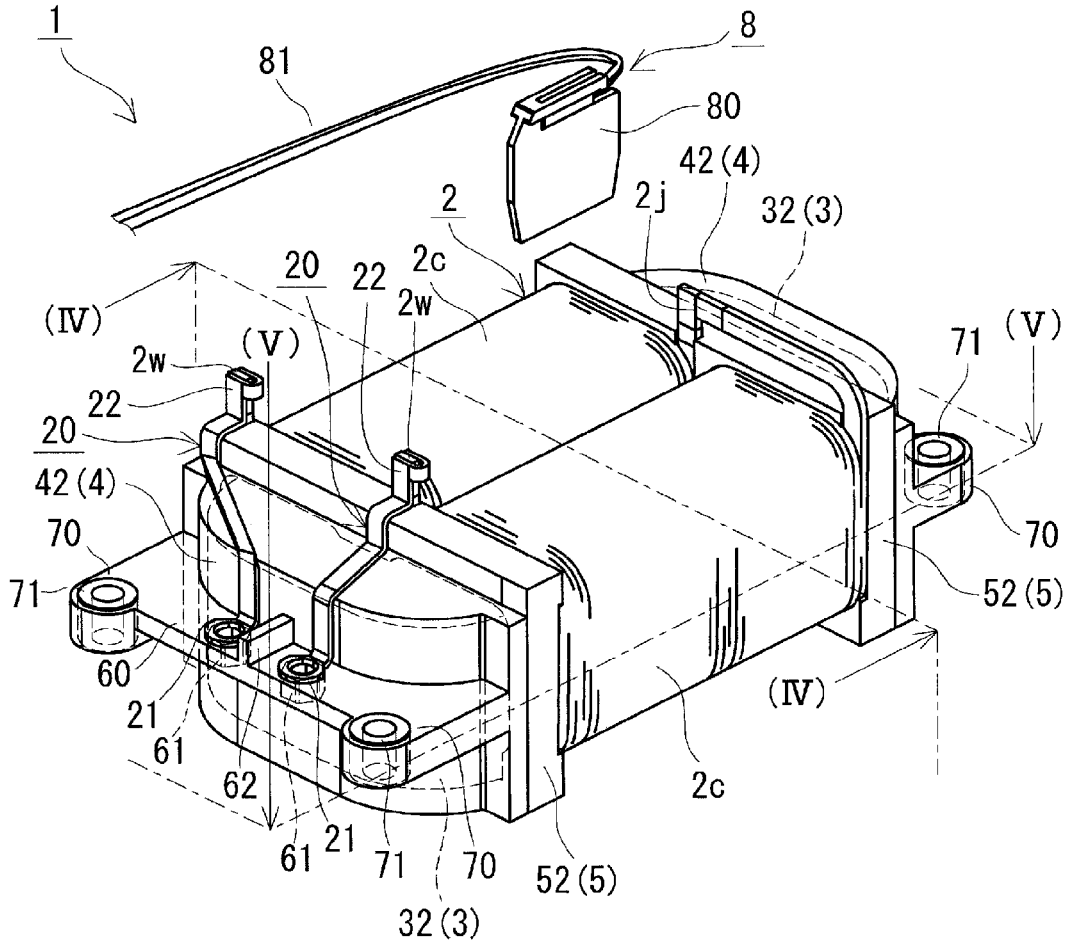
FIG. 1 is a schematic perspective view of a reactor according to Embodiment 1.

The inventors of the present disclosure thought of molding the terminal platform in one piece so as to protrude from the outer side surface (side opposite to the side on which the inner core portions are arranged) of one of the outer resin portions covering the outer core portions, and thereby reducing the height of the reactor compared to the case of forming a terminal platform above the outer core portions. However, in this case, it was found that the following problems occur.

Normally, the coil and the external wiring are connected to each other by fastening terminal fittings connected to the end portions of the winding wires and the terminals of the external wiring to the nuts of the terminal platform with bolts, but at this time, the fastening force of the bolts acts on the terminal platform. If the terminal platform is molded in one piece protruding on the outer surface of the outer resin portion, the terminal platform is bent or broken in some cases due to the fastening force of the bolts, and therefore the terminal platform needs to be made thicker so as to be able to withstand the fastening force of the bolts. However, if the terminal platform is made thicker, there is a risk that the arrangement space can no longer be ensured for the components that are to be arranged near the terminal platform. Accordingly, it is desired that the strength of the terminal platform is ensured and the thickness of the terminal platform is reduced.

The inventors of the present disclosure found that the terminal platform can be made thinner and the strength of the terminal platform can be ensured by molding the terminal platform and the fixing portions in one piece protruding on the outer surfaces of the outer resin portions such that the terminal platform and the fixing portions are continuous with each other. First, embodiments of the present disclosure will be listed and described.

A reactor according to a first aspect of the present disclosure includes a coil that has wound portions formed by winding a winding wire, and a magnetic core that includes inner core portions arranged inside of the wound portions and outer core portions arranged outside of the wound portions, the reactor including: outer resin portions covering at least outer surfaces of the outer core portions; a terminal platform that is formed in one piece protruding on the outer surface of an outer resin portion among the outer resin portions and has fastening portions configured to fasten terminal fittings connected to end portions of the winding wire to terminals of an external wiring; and a fixing portion that is formed in one piece on the terminal platform and is for fixing the reactor to an installation target. The terminal platform and the fixing portion are integrated, and the thickness of the terminal platform is less than that of the fixing portion.

Due to the fact that the terminal platform is molded in one piece protruding on the outer surface of one of the outer resin portions covering the outer core portions, the height of the above-described reactor including the terminal platform can be further reduced compared to a conventional reactor in which the terminal platform is molded in one piece above the outer core portions. According to the above-described reactor, due to the fixing portion for fixing the reactor to the installation target being molded in one piece on the terminal platform and the terminal platform and fixing portion being integrated, the strength of the terminal platform improves and the strength of the terminal platform can be ensured. Accordingly, the thickness of the terminal platform can be reduced and it is also possible to suppress a case in which the terminal platform breaks when the terminal fittings and the terminals of the external wiring are fastened. Also, due to the terminal platform being thinner than the fixing portion, it is easy to ensure space for arranging the components to be arranged near the terminal platform.

In the above-described reactor, due to the fact that the terminal platform is formed in one piece on the outer resin portion, there is no need to attach a separate terminal platform, and therefore it is possible to achieve a reduction of the number of components and simplification of the assembly work, and the manufacturing cost can be reduced.

In one aspect of the above-described reactor, the fastening portions are nuts to which bolts are to be fastened, and the nuts are embedded in the terminal platform.

Due to nuts being embedded in the terminal platform, the fastening portions can be easily formed, and the nuts do not fall out of the terminal platform. Since the terminal fittings and the external wiring can be fastened with bolts, the connection of the coil and the external wiring can be performed easily.

In one aspect of the reactor according to (2) above, bottoms on sides of the nuts opposite to the sides into which the bolts are to be inserted are closed.

Due to the bottom of the nut being closed, wear debris that is produced due to friction between the bolts and the nuts when fastening with the bolts is performed does not fall from inside of the nuts, and it is possible to prevent dispersion of the wear debris.

In one aspect of the above-described reactor, a wall portion formed by the outer resin portion is included between the terminal platform and the fixing portion.

The fixing portions may perform fixing to an installation target with bolts or the like made of metal. In this case, the installation target is at a grounding potential, and a potential difference occurs between the terminal fittings and the bolts provided in the terminal platform. Due to the wall portions formed by the outer resin portions being included between the terminal platform and the fixing portions, it is possible to ensure a sufficient creeping distance between the terminal fittings and the bolts using the wall portions, and thus electrical insulation between the terminal fittings and the bolts can be improved.

In one aspect of the above-described reactor, the reactor includes a sensor configured to measure a physical amount of the reactor, and a wiring locking portion configured to lock a wiring of the sensor is formed on the terminal platform.

If the reactor includes a sensor, the wiring of the sensor can be fixed to the wiring locking portion due to the wiring locking portion being formed on the terminal platform. Accordingly, for example, there is less catching of the wiring of the sensor and the wires are less of a hindrance when installing the reactor in the installation target.

Specific examples of a reactor according to an embodiment of the present disclosure will be described hereinafter with reference to the drawings. Objects with identical names are denoted by identical reference numerals in the drawings. Note that the present disclosure is not limited to these illustrations, but rather is indicated by the claims. All modifications within the meaning and range of equivalency to the claims are intended to be encompassed therein.

Embodiment 1

Configuration of Reactor

Figure 2:
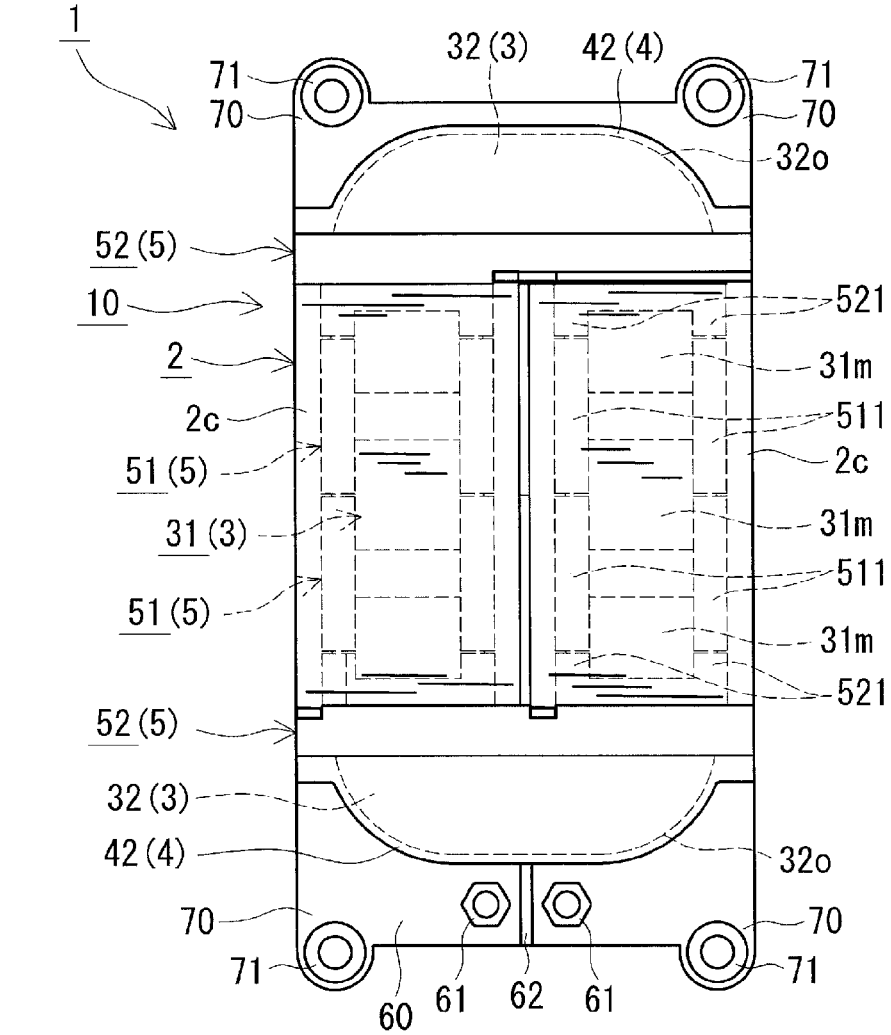
FIG. 2 is a schematic top view of the reactor according to Embodiment 1.
Figure 3:
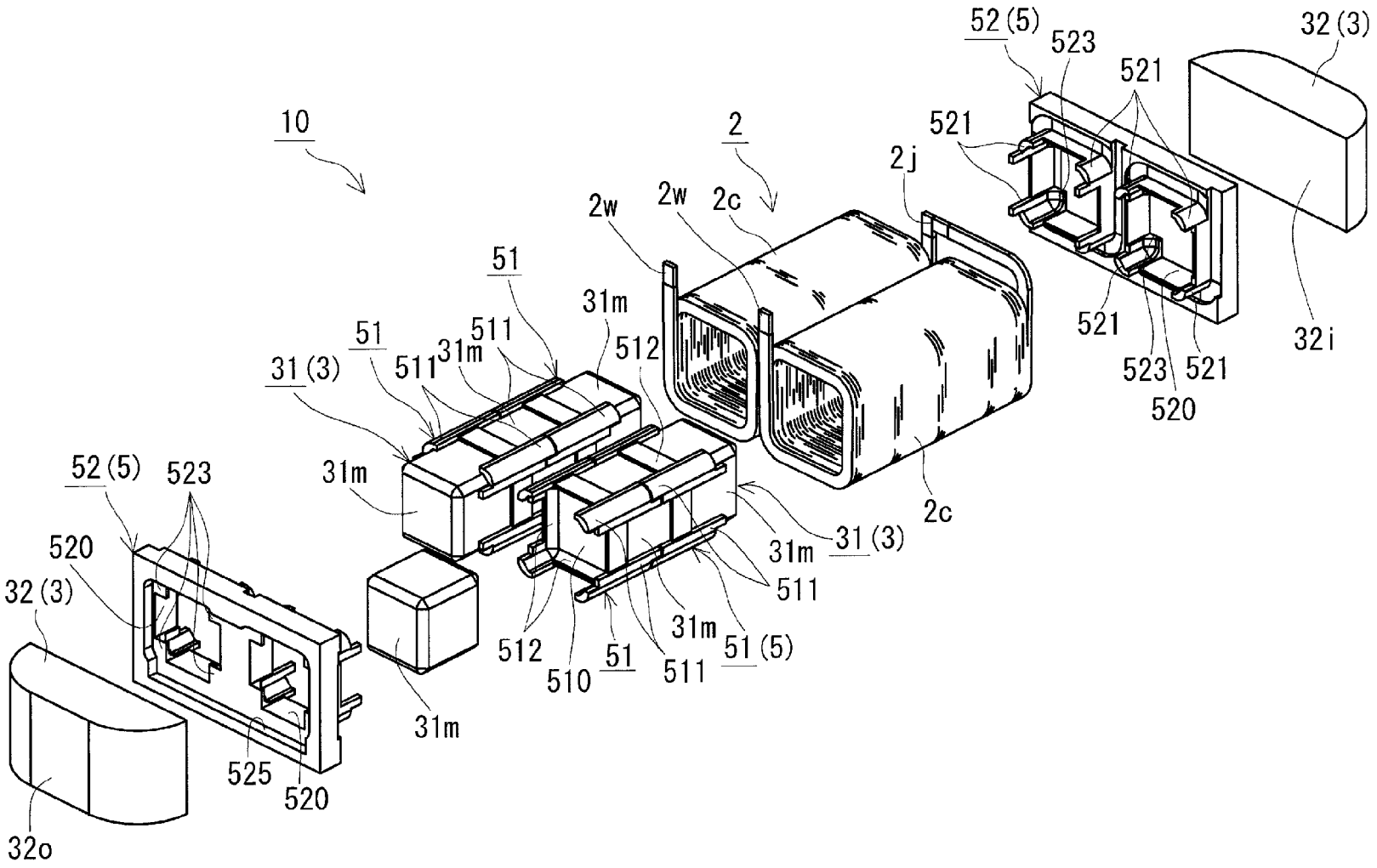
FIG. 3 is a schematic exploded perspective view of a combined body included in the reactor according to Embodiment 1.

A reactor 1 according to Embodiment 1 will be described with reference to FIGS. 1 to 8. As shown in FIGS. 1 to 3, the reactor 1 of Embodiment 1 includes a combined body 10 obtained by combining a coil 2 that has wound portions 2*c*, and a magnetic core 3 arranged inside and outside of the wound portions 2*c*. The coil 2 has two wound portions 2*c*, and the two wound portions 2*c* are arranged side by side. The magnetic core 3 includes two inner core portions 31 that are arranged inside of the wound portion 2*c*, and two outer core portions 32 that are arranged outside of the wound portions 2*c* and connect the end portions of the two inner core portions 31. Also, as shown in FIGS. 1 and 2, the reactor 1 includes outer resin portions 42 (molded resin portion 4) that cover at least outer surfaces 32*o* of the outer core portions 32. One characteristic of the reactor 1 is that a terminal platform 60 and fixing portions 70 are molded in one piece protruding on the outer surface of one of the outer resin portions 42 (see also FIG. 6).

As shown in FIG. 3, the reactor 1 (combined body 10) includes an insulating interposed member 5 that is interposed between the coil 2 and the magnetic core 3.

Figure 4:
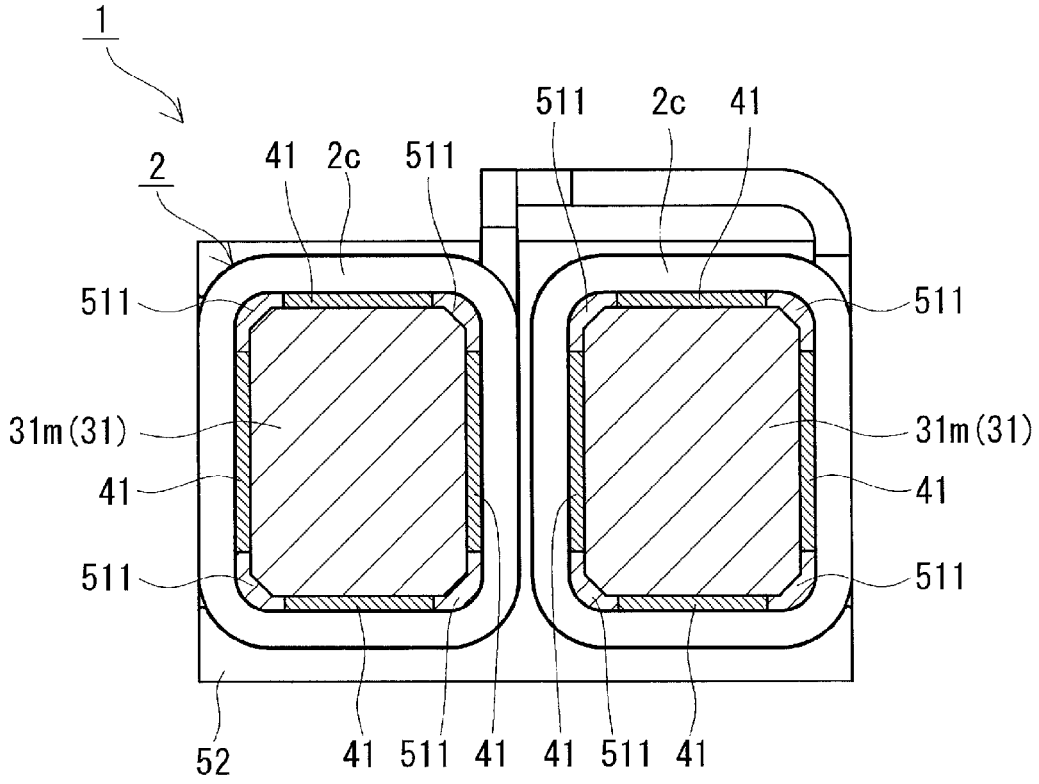
FIG. 4 is a schematic transverse cross-sectional view obtained by cutting along line (IV)-(IV) shown in FIG. 1.
Figure 5:
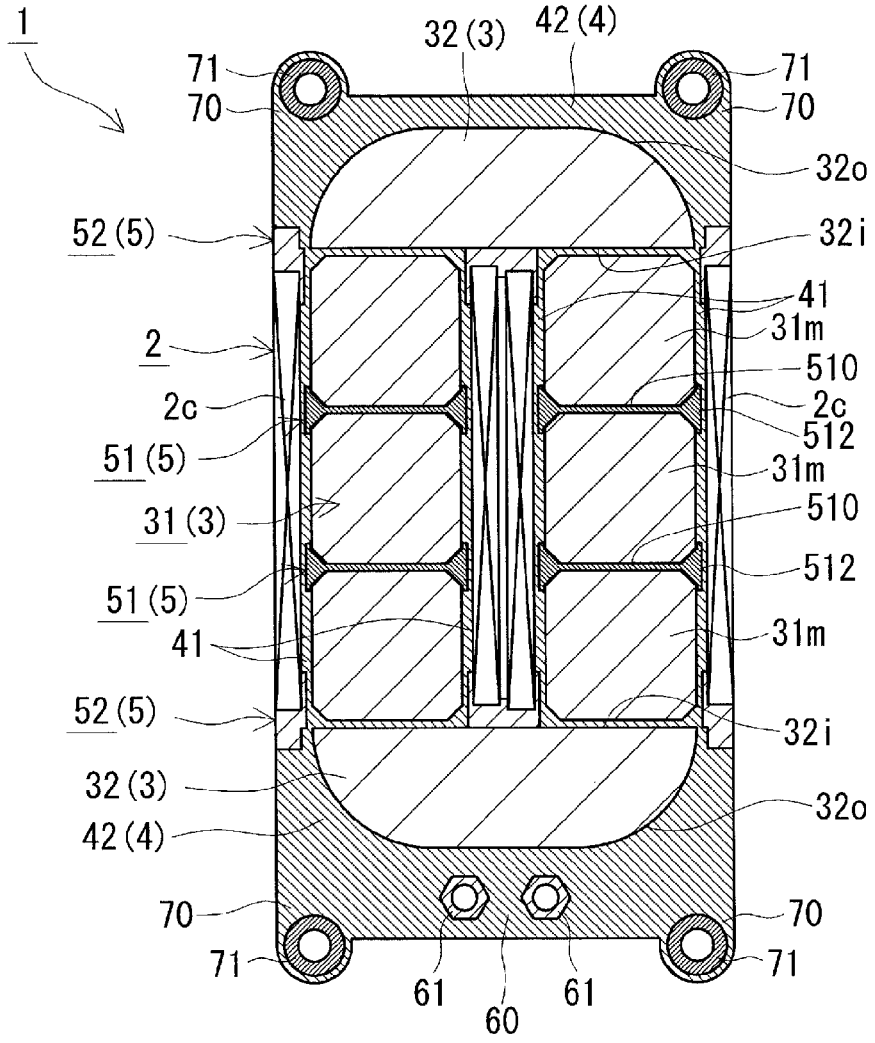
FIG. 5 is a schematic plane cross-sectional view obtained by cutting along line (V)-(V) shown in FIG. 1.
Figure 6:
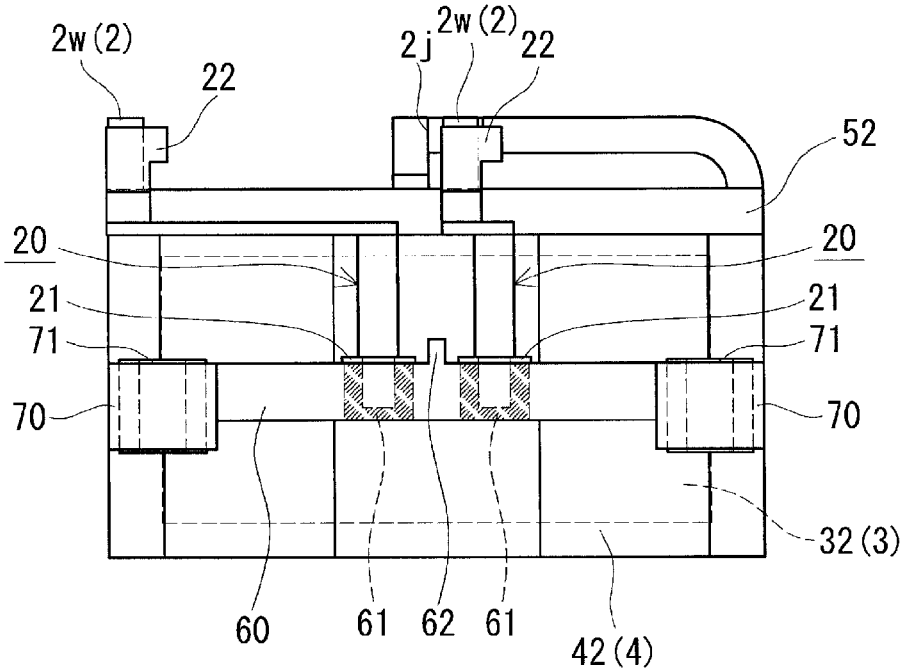
FIG. 6 is a schematic side view of the reactor according to Embodiment 1.

For example, the reactor 1 is installed in an installation target such as a converter case (not shown). Here, in the reactor 1 (the coil 2 and the magnetic core 3), the lower sides of the drawings in FIGS. 1 and 6 are the installation side facing the installation target, the installation side is "downward", the side opposite thereto is "upward", and the up-down direction is the height direction. Also, the direction in which the wound portions 2*c* (inner core portions 31) are arranged side by side (the left-right direction of FIG. 2) is the horizontal direction, and the direction (the up-down direction in the drawing of FIG. 2) along the axial direction of the wound portions 2*c* (inner core portions 31) is the length direction. FIG. 4 is a transverse cross-sectional view obtained by cutting in a lateral direction orthogonal to the length direction of the wound portions 2*c*, and FIG. 5 is a plane cross-sectional view obtained by cutting the wound portions 2*c* with a plane that cuts vertically. Hereinafter, the configuration of the reactor 1 will be described in detail.

Coil

As shown in FIGS. 1 to 3, the coil 2 has two wound portions 2*c* formed by winding two winding wires 2*w* in a spiral shape, and the end portions on one side of the winding wires 2*w* that form the two wound portions 2*c* are connected via a bonding portion 2*j*. The two wound portions 2*c* are arranged side by side (in parallel) such that their axial directions are parallel to each other. The bonding portion 2*j* is formed by bonding the end portions on one side of the winding wires 2*w* pulled out from the wound portions 2*c* using a bonding method such as welding, soldering, or brazing. The end portions on the other side of the winding wires 2*w* are pulled out in a suitable direction (in this example, upward) from the wound portions 2*c*. Later-described terminal fittings 20 (see FIG. 1; not shown in FIG. 2) are attached to the other end portions of the winding wires (that is, the two ends of the coil 2), and are electrically connected to an external device such as a power source (not shown) via external wiring 90 (see FIG. 7). A known coil can be used as the coil 2, and for example, the two wound portions 2*c* may be formed with one continuous winding wire.

Wound Portions

Both wound portions 2*c* are composed of winding wires 2*w* of the same specification and have the same shape, size, winding direction, and number of turns, and adjacent turns that form the wound portions 2*c* are in close contact with each other. For example, the winding wires 2*w* are covered wires (so-called enamel wires) that include a conductor (copper, etc.) and an insulating covering (polyamide imide, etc.) on the outer periphery of the conductor. In this case, the wound portions 2*c* are quadrangular tube-shaped (specifically, rectangular tube-shaped) edgewise coils obtained by winding the winding wires 2*w*, which are covered flat wires, in an edgewise manner, and the shape of the end surface of a wound portion 2*c* viewed in the axial direction is a rectangular shape with rounded corner portions (see also FIG. 4). The shape of the wound portion 2*c* is not particularly limited, and for example, may also be circular tube-shaped, ovoid tube-shaped, elliptical tube-shaped (race-track-shaped), or the like. The specifications of the winding wires 2*w* and the wound portions 2*c* can be changed as appropriate.

In this example, the coil 2 (wound portions 2*c*) is not covered by a later-described molded resin portion 4, and when the reactor 1 is formed, the outer peripheral surface of the coil 2 is exposed as shown in FIG. 1. For this reason, heat is easily dissipated from the coil 2 to the outside, and the heat dissipating property of the coil 2 can be improved.

In addition, the coil 2 may be a molded coil formed using resin having an electrical insulation property. In this case, the coil 2 is protected from the outside environment (dust, corrosion, etc.), and the mechanical strength and electrical insulating property of the coil 2 can be improved. For example, due to the inner peripheral surfaces of the wound portions 2*c* being covered with resin, the electrical insulation between the wound portions 2*c* and the inner core portions 31 can be increased. For example, a thermosetting resin such as epoxy resin, unsaturated polyester resin, urethane resin, or silicone resin, or a thermoplastic resin such as polyphenylene sulfide (PPS) resin, polytetrafluoroethylene (PTFE) resin, liquid crystal polymer (LCP), a polyamide (PA) resin such as nylon 6 or nylon 66, polyimide (PI) resin, polybutylene terephthalate (PBT) resin, or acrylonitrile butadiene styrene (ABS) resin can be used as the resin for molding the coil 2.

Alternatively, the coil 2 may be a thermally welded coil in which a welding layer is included between adjacent turns forming the wound portions 2*c* and the adjacent turns are thermally welded. In this case, the adjacent turns can be adhered together more closely.

As shown in FIGS. 2, 3, and 5, the magnetic core 3 includes two inner core portions 31 that are arranged inside of the wound portions 2*c* and two outer core portions 32 that are arranged outside of the wound portions 2*c*. The inner core portions 31 are portions that are located inside of the wound portions 2*c* arranged side by side, and on which the coil 2 is arranged. That is, the two inner core portions 31 are arranged side by side (in parallel), similarly to the wound portions 2*c*. Portions of the end portions in the axial direction of the inner core portions 31 may protrude from the wound portions 2*c*. The outer core portions 32 are portions that are located outside of the wound portions 2*c* and on which the coil 2 is substantially not arranged (i.e., the outer core portions 32 protrude (are exposed) from the wound portions 2*c*). The outer core portions are provided so as to connect the end portions of the two inner core portions 31. In this example, the ring-shaped magnetic core 3 is formed by the outer core portions 32 being arranged so as to sandwich the inner core portions 31 from the two ends and the end surfaces of the two inner core portions 31 being connected to inner surfaces 32*i* of the outer core portions 32. Magnetic flux flows in the magnetic core 3 when current is applied to the coil 2 causing magnetization, and thus a closed magnetic path is formed.

Inner Core Portions

The shape of the inner core portions 31 is a shape that corresponds to the inner peripheral surfaces of the wound portions 2*c*. In this example, the inner core portions 31 are formed into quadrangular column shapes (rectangular column shapes), and the end surface shape of the inner core portions 31 viewed in the axial direction is a rectangular shape with chamfered corner portions (see also FIG. 4). As shown in FIG. 4, the outer peripheral surface of the inner core portion 31 has four flat surfaces (an upper surface, a lower surface, and two side surfaces) and four corner portions. Also, in this example, as shown in FIGS. 2, 3, and 5, the inner core portion 31 has multiple inner core pieces 31*m*, and the inner core portion 31 is formed by joining the inner core pieces 31*m* in the length direction.

The inner core portion 31 (inner core pieces 31*m*) is made of a material that contains a soft magnetic material. The inner core pieces 31*m* are made of pressed powder molded bodies obtained by press-molding a soft magnetic powder such as iron or an iron alloy (Fe—Si alloy, Fe—Si—Al alloy, Fe—Ni alloy, etc.), a coated soft magnetic powder further including an insulating coating, or the like, a molded body of a composite material including a soft magnetic powder and a resin, or the like. A thermosetting resin, a thermoplastic resin, a room-temperature curable resin, a low-temperature curable resin, or the like can be used as the resin of the composite material. Examples of the thermosetting resin include unsaturated polyester resin, epoxy resin, urethane resin, and silicone resin. Examples of the thermoplastic resin include PPS resin, PTFE resin, LCP, PA resin, PI resin, PBT resin, and ABS resin. In addition, it is also possible to use: a BMC (bulk molding compound), which is obtained by mixing calcium carbonate and glass fibers into unsaturated polyester; a millable silicone rubber; a millable urethane rubber; or the like. In this example, the inner core pieces 31*m* are made of pressed powder molded bodies.

Outer Core Portions

As shown in FIGS. 2 and 3, the outer core portions 32 are columnar members whose upper surfaces are trapezoid-shaped, and are each formed by one core piece. Similarly to the inner core pieces 31*m*, the outer core portions 32 are made of a material containing a soft magnetic material, and the above-described pressed powder molded bodies, molded bodies of a composite material, or the like can be used thereas. In this example, the outer core portions 32 are made of pressed powder molded bodies.

Insulating Interposed Member

The insulating interposed member 5 is a member that is interposed between the coil 2 (wound portions 2*c*) and the magnetic core 3 (inner core portions 31 and outer core portions 32) and ensures electrical insulation between the coil 2 and the magnetic core 3, and includes inner interposed members 51 and end surface interposed members 52. The insulating interposed member 5 (the inner interposed members 51 and the end surface interposed members 52) are made of resin having an electrical insulating property, and for example, may be made of a resin such as epoxy resin, unsaturated polyester resin, urethane resin, silicone resin, PPS resin, PTFE resin, LCP, PA resin, PI resin, PBT resin, or ABS resin.

Inner Interposed Members

As shown in FIGS. 3 to 5, the inner interposed members 51 are interposed between the inner peripheral surfaces of the wound portions 2*c* and the outer peripheral surfaces of the inner core portions 31, and ensure electrical insulation between the wound portions 2 and the inner core portions 31. In this example, as shown in FIGS. 3 and 5, the inner interposed members 51 include rectangular plate portions 510 that are interposed between the inner core pieces 31*m*, and protruding pieces 511 that are formed at the corner portions of the plate portions 510 and extend in the length direction along the corner portions of adjacent inner core pieces 31*m*. Furthermore, in this example, frame portions 512 that surround the peripheral edge portions of the end surfaces of adjacent inner core pieces 31*m* are formed on the outer edge portions of the plate portions 510. The plate portions 510 hold the gaps between the inner core pieces 31*m* and function as gap members. The protruding pieces 511 hold the corner portions of the inner core pieces 31*m*, are interposed between the inner peripheral surfaces of the wound portions 2*c* and the outer peripheral surfaces of the inner core pieces 31*m*, and position the inner core pieces 31*m* (inner core portions 31) in the wound portions 2*c*. As shown in FIG. 4, gaps are formed between the inner peripheral surfaces of the wound portions 2*c* and the outer peripheral surfaces of the inner core portions 31 by the protruding pieces 511, and gaps are ensured at the four surfaces (upper surface, lower surface, and side surface) of the inner core portions 31. The gaps are flow paths for resin that forms the later-described inner resin portions 41 (see FIGS. 4 and 5), and the inner resin portions 41 are formed by filling the gaps with resin. Also, as shown in FIG. 3, the protruding pieces 511 of adjacent inner interposed members 51 abut against each other and are joined to each other.

End Surface Interposed Members

Figure 8:
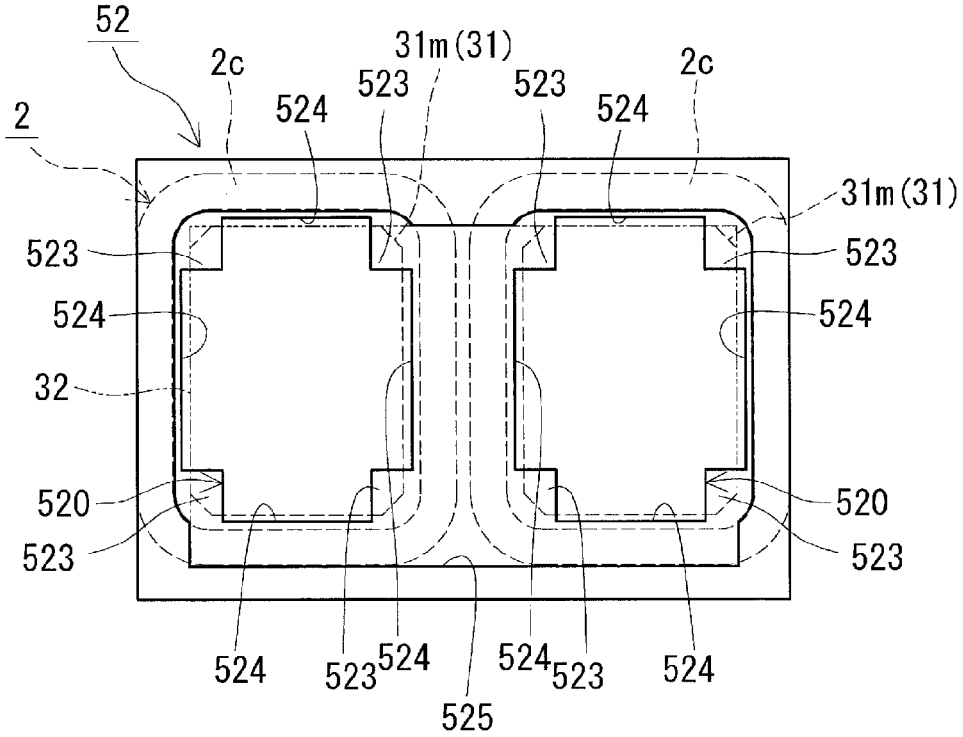
FIG. 8 is a schematic front view of an end surface interposed member included in the reactor according to Embodiment 1, as viewed from a front side.

As shown in FIGS. 3 and 5, the end surface interposed members 52 are interposed between the end surfaces of the wound portions 2*c* and the inner surfaces 32*i* of the outer core portions 32, and thus electrical insulation between the wound portions 2*c* and the outer core portions 32 is ensured. The end surface interposed members 52 are arranged at both ends of the wound portions 2*c*, and as shown in FIG. 3, the end surface interposed members 52 are rectangular frame-shaped members each provided with two through holes 520 into which the inner core portions 31 are to be inserted. In this example, as shown in FIG. 8, when the end surface interposed members 52 are viewed from the outer core portion 32 side (the front side), projections 523 that protrude inward of the through holes 520 are formed so as to come into contact with the corner portions of the end surfaces of the inner core portions 31 (inner core pieces 31*m*). The projections 523 are interposed between the corner portions of the end surfaces of the inner core portions 31 and the inner surfaces 32*i* of the outer core portions 32, and as shown in FIG. 5, gaps are formed between the end surfaces of the inner core portions 31 and the inner surfaces 32*i* of the outer core portions 32. Also, as shown in FIG. 8, the through holes 520 are formed into cross shapes, and in the state of the combined body 10, resin filling holes 524 that are in communication with the gaps between the inner peripheral surfaces of the wound portions 2*c* and the outer peripheral surfaces of the inner core portions 31 are formed at the through holes 520. The gaps between the wound portions 2*c* and the inner core portions 31 can be filled with the resin via the resin filling holes 524.

As shown in FIGS. 3 and 8, recessed fitting portions 525, into which the inner surface 32*i* sides of the outer core portions 32 are to be fit, are formed on the outer core portion 32 sides (front sides) of the end surface interposed members 52, and the outer core portions 32 are positioned with respect to the end surface interposed members 52 by the fitting portions 525. As shown in FIG. 3, protruding pieces 521 that extend in the length direction along the corner portions of the inner core pieces 31*m* located on the end portions of the inner core portions 31 are formed on the inner core portion 31 sides (rear sides) of the end surface interposed members 52. The protruding pieces 521 hold the corner portions of the inner core pieces 31*m* located on the end portions of the inner core portions 31, are interposed between the inner peripheral surfaces of the wound portions 2*c* and the outer peripheral surfaces of the inner core pieces 31*m*, and position the inner core pieces 31*m* in the wound portions 2*c*. The inner core portions 31 are positioned with respect to the end surface interposed members 52 by the protruding pieces 521, and as a result, the inner core portions 31 and the outer core portions 32 can be positioned via the end surface interposed members 52. Also, as shown in FIG. 2, the protruding pieces 521 of the end surface interposed members 52 abut against and are joined to the protruding pieces 511 of the inner interposed members 51. Accordingly, as shown in FIG. 4, over the length direction of the inner core portions 31, gaps between the inner peripheral surfaces of the wound portions 2*c* and the outer peripheral surfaces of the inner core portions 31 are divided in the peripheral direction by the protruding pieces 511 and the protruding pieces 521.

Outer Resin Portion

As shown in FIGS. 1 and 2, the outer resin portions 42 are formed so as to cover at least the outer surfaces 32*o* of the outer core portions 32 (surfaces on the sides opposite to the inner surfaces 32*i* at which the inner core portions 31 are arranged). In this example, the outer resin portions 42 are formed so as to cover the entireties of the outer peripheral surfaces of the outer core portions 32 that are exposed to the outside when the combined body 10 is assembled, and not only the outer surfaces 32*o*, but also the upper surfaces and lower surfaces of the outer core portions 32 are covered by the outer resin portions 42. The outer resin portions 42 are formed by covering the outer core portions 32 with resin through injection molding.

The outer resin portions 42 are made of resin that has an electrical insulation property. A thermosetting resin, a thermoplastic resin, a room-temperature curable resin, a low-temperature curable resin, and the like can be used as the resin for forming the outer resin portions 42. For example, a thermosetting resin such as epoxy resin, unsaturated polyester resin, urethane resin, and silicone resin, or a thermoplastic resin such as PPS resin, PTFE resin, LCP, PA resin, PI resin, PBT resin, and ABS resin can be used.

In this example, as shown in FIGS. 4 and 5, inner resin portions 41 fill the spaces between the inner peripheral surfaces of the wound portions 2*c* and the outer peripheral surfaces of the inner core portions 31. The inner resin portions 41 are formed by filling the gaps between the wound portions 2*c* and the inner core portions 31 with resin through injection molding, and the inner resin portions 41 are in close contact with the inner peripheral surfaces of the wound portions 2*c* and the outer peripheral surfaces of the inner core portions 31. As shown in FIG. 5, the inner resin portions 41 and the outer resin portions 42 are formed in one piece, and a molded resin portion 4 is formed by the inner resin portions 41 and the outer resin portions 42. The inner core portions 31 and the outer core portions 32 are integrated by the molded resin portion 4, and the coil 2, the magnetic core 3, and the insulating interposed member 5, which constitute the combined body 10, are integrated by the molded resin portion 4. Also, as shown in FIG. 5, the gaps between the end surfaces of the outer core portions 31 and the inner surfaces 32*i* of the outer core portions 32 are also filled with resin.

Terminal Platform

As shown in FIGS. 1 and 2, the terminal platform 60 is molded in one piece protruding on the outer surface of one of the outer resin portions 42, and includes fastening portions (nuts 61) for fastening the terminal fittings 20 and terminals 91 (see FIG. 7) of the external wiring 90. In this example, two fastening portions are provided on the terminal platform 60 so as to correspond to the terminal fittings 20 connected to the winding wires 2*w*. The terminal platform 60 is provided on the outer resin portion 42 covering one outer core portion 32 at which the end portions of the winding wires 2*w* are located.

In this example, the fastening portions are formed by the nuts 61 being embedded in the terminal platform 60. The nuts 61 include threaded holes with female threading formed on their inner circumferential surfaces, and the bolts 65 (see FIG. 7) are fastened thereto. Polygonal nuts with polygonal exteriors or circular nuts with circular exteriors can be used as the nuts 61, and in this example, a case is shown in which hexagonal nuts are used (see FIGS. 2 and 5). Also, the nuts 61 are so-called cap nuts, and as shown in FIG. 6, the bottoms on the side opposite to the side into which the bolts 65 are inserted are closed. In FIG. 6, the cross sections of the nuts 61 are hatched in order to make it easier to understand. In FIG. 6, a case is shown in which the nuts 61 are cap nuts, but the nuts 61 may also be open nuts with threaded holes open on both sides.

Terminal Fittings

The terminal fittings 20 are rod-shaped conductors, and as shown in FIGS. 1 and 6, are connected to the end portions of the winding wires 2*w* and are routed between the end portions of the winding wires 2*w* and the fastening portions (nuts 61). The terminal fittings 20 include terminal portions 21 that are arranged on the nuts 61 embedded in the terminal platform 60 and are fastened to terminals 91 (see FIG. 7) of the external wiring 91, and connection portions 22 connected to end portions of the winding wires 2*w*. The terminal portions 21 are formed into circular ring plate shapes and have through holes through which the bolts 65 are to be inserted. The connection portions 22 are formed into U shapes so as to sandwich the end portions of the winding wires 2*w*, and are connected to the end portions of the winding wires 2*w* through a bonding method such as welding, soldering, or brazing. The external wiring 90 shown in FIG. 7 is provided with terminals 91 at its terminal end, and the terminals 91 are provided with through holes through which the bolts 65 are inserted.

Figure 7:
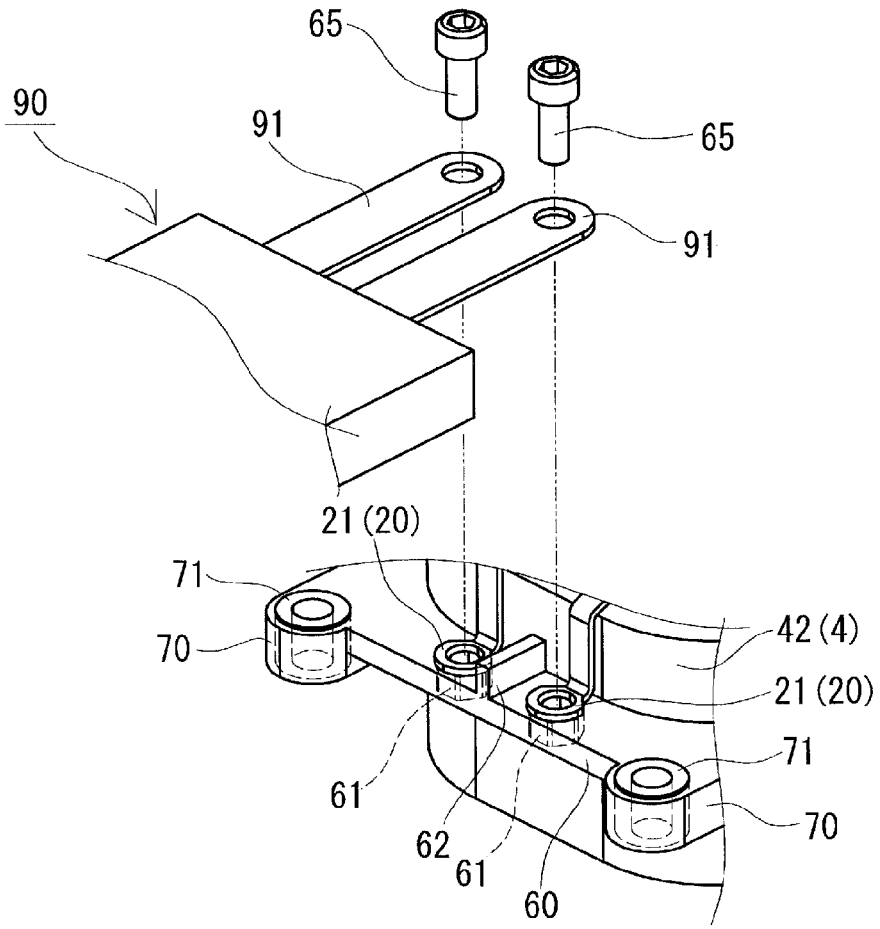
FIG. 7 is a diagram illustrating a method of fastening terminal fittings and terminals of external wiring in the reactor according to Embodiment 1.

As shown in FIG. 7, the terminal fittings 20 and the terminals 91 of the external wiring 90 are fastened by placing the terminals 91 of the external wiring 90 on the terminal portions 21 of the terminal fittings 20 arranged on the nuts 61, inserting the bolts 65 into the nuts 61 from above, and tightening the bolts 65. Commercially-available nuts and bolts made of metal can be used as the nuts 61 and the bolts 65.

In this example, as shown in FIGS. 1 and 6, a partitioning portion 62 formed by the outer resin portion 42 is included on the terminal platform 60 so as to separate the terminal fittings 20. The partitioning portion 62 increases the creeping distance between the terminal fittings 20 and can increase the electrical strength between the terminal fittings 20. The height of the partitioning portion 62 need only be set as appropriate such that the needed creeping distance can be ensured according to the voltage applied to the coil 2, the usage environment, and the like.

Fixing Portions

Fixing portions 70 are for fixing the reactor 1 to the installation target (not shown), and as shown in FIGS. 1 and 2, the fixing portions 70 are molded in one piece with the terminal platform 60. Collars 71 (tube bodies) made of metal are embedded in the fixing portions 70, thus forming through holes through which bolts to be used as fixing tools are inserted. The reactor 1 is fixed to the installation target by inserting the bolts (not shown) into the collars 71 of the fixing portions 70 and fastening the bolts in bolt holes provided in the installation target. Commercially-available collars and bolts made of metal can be used as the collars 71 and the bolts used as the fixing tools.

In this example, as shown in FIG. 2, the fixing portions 70 are provided on the outer resin portions 42 covering the two outer core portions 32, and two fixing portions 70 are provided on each outer resin portion 42. The fixing portions 70 are arranged on both the left and right sides of the outer resin portions 42, and the terminal platform 60 is provided spanning between the fixing portions 70. The number and positions of the fixing portions 70 can be changed as appropriate, and one fixing portion 70 may also be provided on each outer resin portion 42.

As shown in FIGS. 1 and 6, the terminal platform 60 and the fixing portions 70 protrude in one piece from the outer surface of one of the outer resin portions 42 to form one protruding portion, and the thickness of the terminal platform 60 is less than that of the fixing portions 70. In this example, the terminal platform 60 and the fixing portions 70 are provided at an intermediate position in the height direction of the outer resin portions 42. The positions at which the terminal platform 60 and the fixing portions 70 are provided can be changed as appropriate, and may be on the upper side or the lower side of the outer resin portions 42 in the height direction. Ribs (not shown) may be formed on the lower sides of the terminal platforms 60, and in this case, the rigidity of the fixing portions 70 can be increased by the ribs.

Sensor

As shown in FIG. 1, the reactor 1 may also include a sensor 8 for measuring a physical amount. The sensor 8 shown in FIG. 1 is held in a sensor holder 80 and includes wiring 81 for transmitting detection information (electrical signals) of the sensor 8 to a control apparatus (not shown) or the like. The sensor 8 can be selected as appropriate according to the physical amount to be measured. In this example, the sensor 8 is a thermistor for measuring the temperature of the coil 2, and is attached such that the sensor holder 80 is inserted between the wound portions 2*c* and is arranged on the upper side between the wound portions 2*c*.

Method for Manufacturing Reactor

An example of a method for manufacturing the reactor 1 will be described. The method for manufacturing the reactor is divided into two steps: a combined body assembly step and a resin molding step.

Combined Body Assembly Step

In the combined body assembly step, the combined body 10 including the coil 2, the magnetic core 3, and the insulating interposed member 5 is assembled (see FIG. 3).

In this example, the inner core portions 31 are produced by arranging the inner interposed members 51 between the inner core pieces 31*m*, and the inner core portions 31 are inserted into the two wound portions 2*c* of the coil 2. Thereafter, the end surface interposed members 52 are arranged on the two ends of the wound portions 2*c*, and the outer core portions 32 are arranged so as to sandwich the inner core portions 31 from the two ends. Accordingly, a ring-shaped magnetic core 3 (see FIG. 2) is formed by the inner core portions 31 and the outer core portions 32. As described above, the combined body 10 including the coil 2, the magnetic core 3, and the insulating interposed members 5 is assembled.

Resin Molding Step

In the resin molding step, the outer resin portions 42 are formed by performing injection molding of resin on the outer core portions 32, and the terminal platform 60 and the fixing portions 70 are molded in one piece on an outer resin portion 42 (see FIGS. 1 and 5).

In this example, the combined body 10 is set in a mold (not shown), and components such as the nuts 61 and the collars 71 are arranged in the space for forming the terminal platform 60 and the fixing portions 70 in the mold. Then, the resin is injected from the outer core portion 32 sides of the combined body 10, the outer core portions 32 are covered with the resin, and the resin fills the spaces for forming the terminal platform 60 and the fixing portions 70 in the mold. At this time, the resin fills the gaps between the wound portions 2*c* and the inner core portions 31 via the resin filling holes 524 of the end surface interposed members 52, and the resin also fills the gaps between the end surfaces of the inner core portions 31 and the inner surfaces 32*i* of the outer core portions 32. Thereafter, by allowing the resin to cure, the terminal platform 60 in which the nuts 61 are embedded and the fixing portions 71 in which the collars 71 are embedded are molded in one piece with the outer resin portions 42 at the same time as the outer resin portions 42 are formed. Also, in this example, the outer resin portions 42 and the inner resin portions 41 are formed in one piece by forming the inner resin portions 41 at the same time as the outer resin portions 42. Accordingly, the molded resin portion 4 is formed by the outer resin portions 42 and the inner resin portions 41, the inner core portions 31 and the outer core portions 32 are integrated, and the coil 2, the magnetic core 3, and the insulating interposed member 5 are integrated.

The resin may fill the gaps between the wound portions 2*c* and the inner core portions 31 from one outer core portion 32 to another outer core portion 32, or the resin may fill the gaps from both outer core portions 32.

Actions and Effects

The reactor 1 of Embodiment 1 exhibits the following actions and effects.

Due to the fact that the terminal platform 60 is molded in one piece protruding on the outer surface of the outer resin portion 42 covering the outer core portion 32, the height of the reactor 1 including the terminal platform 60 can be further reduced. Also, due to the fact that the terminal platform is molded in one piece on the outer resin portion 42, there is no need to attach a separate terminal platform, and thus it is possible to achieve a reduction of the number of components and simplification of the assembly work.

The terminal platform 60 and the fixing portions 70 are molded in one piece on the outer resin portion 42 and are joined to each other to form one piece, and thus the strength of the terminal platform 60 improves. Accordingly, the thickness of the terminal platform 60 can be reduced and the strength of the terminal platform 60 can be ensured, and therefore it is possible to suppress the case in which the terminal platform 60 breaks when the terminal fittings 20 and the terminals 91 of the external wiring 90 are fastened with bolts. Due to the thickness of the terminal platform 60 being less than that of the fixing portions 70, the arrangement space for the components arranged near the terminal platform 60 is easily ensured.

Due to the nuts 61 being embedded in the terminal platform 60, the fastening portions can be formed easily. Since the terminal fittings 20 and the terminals 91 of the external wiring 90 can be fastened with bolts, the coil 2 and the external wiring 90 can be connected easily. Also, due to the bottoms of the nuts 61 being closed, wear debris (metal debris) that is produced due to friction between the bolts 65 and the nuts 61 when bolt fastening is performed does not fall from inside of the nuts 61. For this reason, it is possible to avoid trouble such as short-circuiting caused by the wear debris, and reliability can be improved.

Modified Example 1

Figure 9:
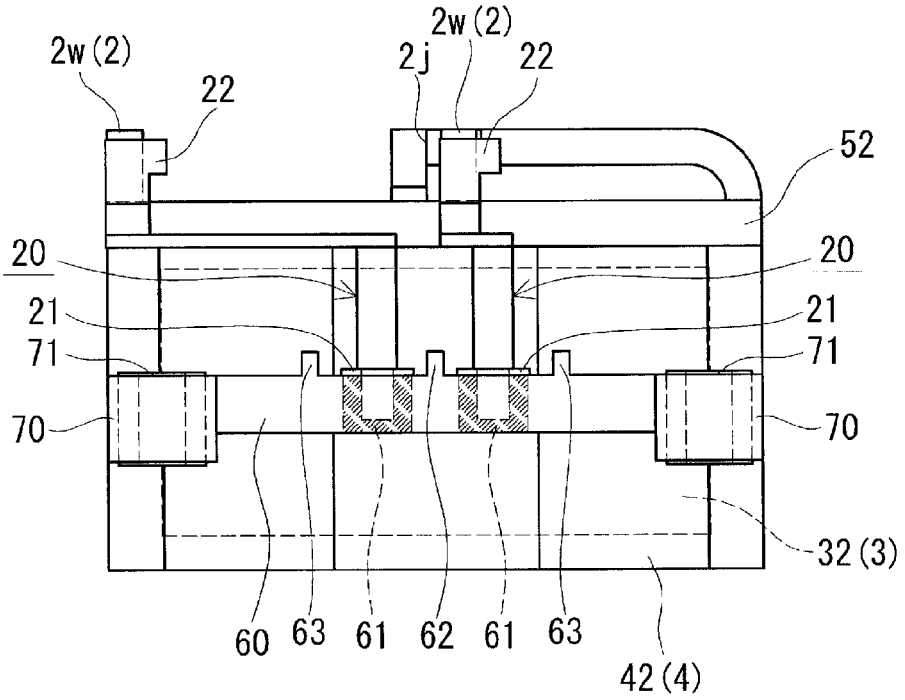
FIG. 9 is a schematic side view showing an example of a reactor according to Modified Example 1.
Figure 10:
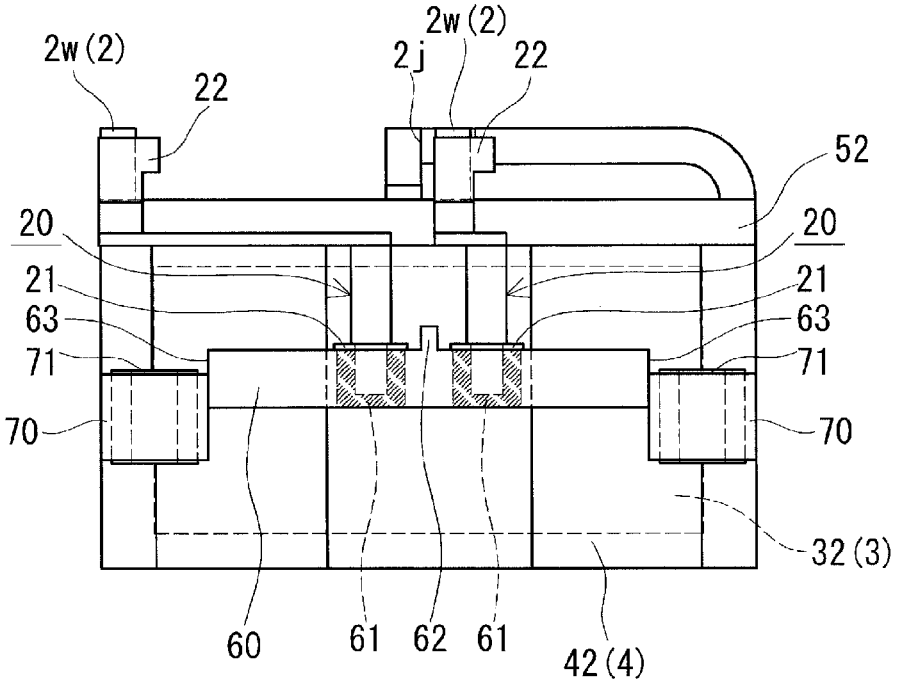
FIG. 10 is a schematic side view showing another example of a reactor according to Modified Example 1.

As shown in FIGS. 9 and 10, a wall portion 63 may also be formed by the outer resin portions 42 between the terminal platforms 60 and the fixing portions 70. FIG. 9 shows a form in which the upper surfaces of the terminal platform 60 and the fixing portions 70 are at approximately the same height, and wall portions 63 are formed so as to protrude from the upper surface. On the other hand, FIG. 10 shows a form in which the heights of the upper surfaces of the terminal platform 60 and the fixing portions 70 are different, and the wall portions 63 are formed by level differences between the terminal platform 60 and the fixing portions 70. In both cases, the wall portions 63 are included between the terminal platform 60 and the fixing portions 70, and thus it is possible to increase the creeping distance between the bolts inserted through the terminal fittings 20 and the fixing portions 70 (collars 71) using the wall portions 63, and the electrical insulation between the terminal fittings 20 and the fixing portions 70 can be improved. The height of the wall portions 63 need only be set as appropriate such that the needed creeping distance can be ensured according to the voltage applied to the coil 2, the usage environment, and the like.

Modified Example 2

Figure 11:
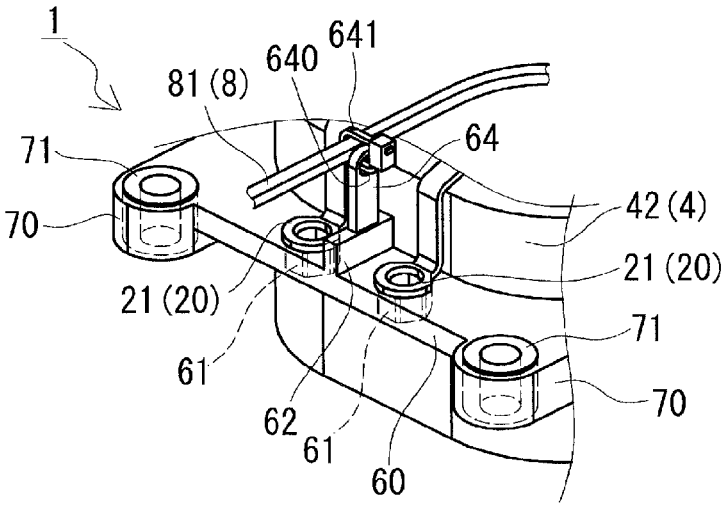
FIG. 11 is an enlarged perspective view showing a wiring locking portion of a reactor according to Modified Example 2.

As illustrated in FIG. 1, if the reactor 1 includes the sensor 8, a wiring locking portion 64 for locking the wiring 81 of the sensor 8 may also be formed on the terminal platform 60. The wiring locking portion 64 shown in FIG. 11 is a protruding piece in the form of a tongue piece that is molded in one piece with the terminal platform 60 and extends upward from the partitioning portion 62, and an attachment hole 640 is formed in the leading end thereof. Also, by passing a cable tie 641 through the attachment hole 640 to bundle the wiring 81, the wiring 81 is locked to the wiring locking portion 64. Since the wiring 81 of the sensor 8 can be fixed to the wiring locking portion 64 due to the wiring locking portion 64 being provided on the terminal platform 60, for example, the wiring 81 gets caught less and the wiring 81 is less of a hindrance when the reactor 1 is installed on the installation target or the like.

The invention claimed is:

1. A reactor including a coil that has wound portions formed by winding a winding wire, and a magnetic core that includes inner core portions arranged inside of the wound portions and outer core portions arranged outside of the wound portions, the reactor comprising:

outer resin portions covering at least outer surfaces of the outer core portions;

a terminal platform that is formed in one piece protruding on the outer surface of an outer resin portion among the outer resin portions, the terminal platform being a plate-shaped member and has fastening portions configured to fasten terminal fittings connected to end portions of the winding wire to terminals of an external wiring; and a fixing portion that is formed in one piece on the terminal platform and is for fixing the reactor to an installation target, wherein the terminal platform and the fixing portion are integrated, and the thickness of the terminal platform is less than that of the fixing portion, and wherein the fastening portions and the fixing portion are coplanar.

2. The reactor according to claim 1, wherein the fastening portions are nuts to which bolts are to be fastened, and the nuts are embedded in the terminal platform.

3. The reactor according to claim 2, wherein sides of the nuts opposite to the sides into which the bolts are to be inserted are closed.

4. The reactor according to claim 1, wherein a wall portion formed by the outer resin portion is included between the terminal platform and the fixing portion.

5. The reactor according to claim 1, further comprising:

a sensor configured to measure a physical amount of the reactor, wherein a wiring locking portion configured to lock a wiring of the sensor is formed on the terminal platform.

6. The reactor according to claim 2, wherein a wall portion formed by the outer resin portion is included between the terminal platform and the fixing portion.

7. The reactor according to claim 3, wherein a wall portion formed by the outer resin portion is included between the terminal platform and the fixing portion.

8. The reactor according to claim 2, further comprising:

a sensor configured to measure a physical amount of the reactor, wherein a wiring locking portion configured to lock a wiring of the sensor is formed on the terminal platform.

9. The reactor according to claim 3, further comprising:

a sensor configured to measure a physical amount of the reactor, wherein a wiring locking portion configured to lock a wiring of the sensor is formed on the terminal platform.

10. The reactor according to claim 4, further comprising:

a sensor configured to measure a physical amount of the reactor, wherein a wiring locking portion configured to lock a wiring of the sensor is formed on the terminal platform.

* * * * *